US006346027B1

(12) United States Patent
Merkovsky

(10) Patent No.: US 6,346,027 B1
(45) Date of Patent: Feb. 12, 2002

(54) NURSING BRA DEVICE

(76) Inventor: Diane Merkovsky, 88 W. Madison Ave., Dumont, NJ (US) 07628

( * ) Notice: Subject to any disclaimer, the term of this patent is extended or adjusted under 35 U.S.C. 154(b) by 0 days.

(21) Appl. No.: 09/922,287

(22) Filed: Aug. 3, 2001

(51) Int. Cl.[7] ..... A41C 3/00
(52) U.S. Cl. ..... 450/37; 450/38; 450/36
(58) Field of Search ..... 450/1, 37, 38, 450/36, 55–58

(56) References Cited

U.S. PATENT DOCUMENTS

| | | | | | |
|---|---|---|---|---|---|
| 2,890,702 | A | * | 6/1959 | Farino | 450/36 |
| 3,952,752 | A | * | 4/1976 | Huttle, Jr. | 450/36 |
| D246,729 | S | | 12/1977 | Murphy | |
| 4,295,469 | A | | 10/1981 | Lindgren | |
| 4,390,024 | A | * | 6/1983 | Williams | 450/36 |
| 4,550,734 | A | | 11/1985 | Porco | |
| 4,878,879 | A | * | 11/1989 | Kunstadter | 450/36 |
| 4,911,677 | A | | 3/1990 | White | |
| 5,149,336 | A | | 9/1992 | Clarke et al. | |
| 5,269,720 | A | * | 12/1993 | Moretz et al. | 450/37 |
| 5,964,641 | A | | 10/1999 | Laughridge | |
| 6,083,079 | A | * | 1/2000 | Pearson | 450/1 |

* cited by examiner

*Primary Examiner*—Gloria M. Hale

(57) ABSTRACT

A nursing bra device for preventing breast milk from leaking through a bra. The nursing bra device includes a bra with a pair of cup frames positioned on a torso strap. Each of a pair of shoulder straps extends between one of the cup frames and the torso strap. Each of a pair of bra cups is attached to one of the cup frames such that a portion of each of the bra cups defines a flap for opening and closing an opening defined by the cup frames. Each of the flaps has a hole therein. Each of the bra cups has an inner layer and an outer layer. The inner layer comprises an absorbent material. Each of a pair of hook members is attached to one of the cup frames and selectively holds the flaps in a closed position.

4 Claims, 1 Drawing Sheet

10
12
14
16
18
20
22
24
26
28
30
31
32
34
36
38
40
42
2
2

NURSING BRA DEVICE

BACKGROUND OF THE INVENTION

1. Field of the Invention

The present invention relates to nursing bras and more particularly pertains to a new nursing bra device for preventing breast milk from leaking through a bra.

2. Description of the Prior Art

The use of nursing bras is known in the prior art. More specifically, nursing bras heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,911,677; 4,259,469; 5,149,336; 5,964,641; 4,550,734; and Des. U.S. Pat. No. 246,729.

While these devices fulfill their respective, particular objectives and requirements, the aforementioned patents do not disclose a new nursing bra device. The inventive device includes a bra with a pair of cup frames positioned on a torso strap. The torso strap has a pair of ends. Each of a pair of shoulder straps extends between an apex of one of the cup frames and the torso strap. A fastening means removably fastens the first end of the torso strap to the second end of the torso strap. Each of a pair of bra cups is attached to one of the cup frames such that a portion of each of the bra cups defines a flap for opening and closing an opening defined by the cup frames. Each of the flaps has a hole therein. Each of the bra cups has an inner layer and an outer layer. The inner layer comprises an absorbent material, and the outer layer comprises a generally waterproof material. A pair of hook members selectively hold the flaps in a closed position. Each of the hook members is attached to one of the cup frames and is located for extending into the holes of the bra cups for holding the flaps in the closed position.

In these respects, the nursing bra device according to the present invention substantially departs from the conventional concepts and designs of the prior art, and in so doing provides an apparatus primarily developed for the purpose of preventing breast milk from leaking through a bra.

SUMMARY OF THE INVENTION

In view of the foregoing disadvantages inherent in the known types of nursing bras now present in the prior art, the present invention provides a new nursing bra device construction wherein the same can be utilized for preventing breast milk from leaking through a bra.

The general purpose of the present invention, which will be described subsequently in greater detail, is to provide a new nursing bra device apparatus and method which has many of the advantages of the nursing bras mentioned heretofore and many novel features that result in a new nursing bra device which is not anticipated, rendered obvious, suggested, or even implied by any of the prior art nursing bras, either alone or in any combination thereof.

To attain this, the present invention generally comprises a bra with a pair of cup frames positioned on a torso strap. The torso strap has a pair of ends. Each of a pair of shoulder straps extends between an apex of one of the cup frames and the torso strap. A fastening means removably fastens the first end of the torso strap to the second end of the torso strap. Each of a pair of bra cups is attached to one of the cup frames such that a portion of each of the bra cups defines a flap for opening and closing an opening defined by the cup frames. Each of the flaps has a hole therein. Each of the bra cups has an inner layer and an outer layer. The inner layer comprises an absorbent material, and the outer layer comprises a generally waterproof material. A pair of hook members selectively hold the flaps in a closed position. Each of the hook members is attached to one of the cup frames and is located for extending into the holes of the bra cups for holding the flaps in the closed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new nursing bra device apparatus and method which has many of the advantages of the nursing bras mentioned heretofore and many novel features that result in a new nursing bra device which is not anticipated, rendered obvious, suggested, or even implied by any of the prior art nursing bras, either alone or in any combination thereof.

It is another object of the present invention to provide a new nursing bra device which may be easily and efficiently manufactured and marketed.

It is a further object of the present invention to provide a new nursing bra device which is of a durable and reliable construction.

An even further object of the present invention is to provide a new nursing bra device which is susceptible of a low cost of manufacture with regard to both materials and labor, and which accordingly is then susceptible of low prices of sale to the consuming public, thereby making such nursing bra device economically available to the buying public.

Still yet another object of the present invention is to provide a new nursing bra device which provides in the apparatuses and methods of the prior art some of the advantages thereof, while simultaneously overcoming some of the disadvantages normally associated therewith.

Still another object of the present invention is to provide a new nursing bra device for preventing breast milk from leaking through a bra.

Yet another object of the present invention is to provide a new nursing bra device which includes a bra with a pair of cup frames positioned on a torso strap. The torso strap has a pair of ends. Each of a pair of shoulder straps extends between an apex of one of the cup frames and the torso strap. A fastening means removably fastens the first end of the torso strap to the second end of the torso strap. Each of a pair of bra cups is attached to one of the cup frames such that a portion of each of the bra cups defines a flap for opening and closing an opening defined by the cup frames. Each of the flaps has a hole therein. Each of the bra cups has an inner layer and an outer layer. The inner layer comprises an absorbent material, and the outer layer comprises a generally waterproof material. A pair of hook members selectively hold the flaps in a closed position. Each of the hook members is attached to one of the cup frames and is located for extending into the holes of the bra cups for holding the flaps in the closed position.

Still yet another object of the present invention is to provide a new nursing bra device that has the absorbent material built into the bra cups. This eliminates the need for additional pads which can shift causing leakage or do not conform to the breast so that they are noticeably visible through the user's clothes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3:
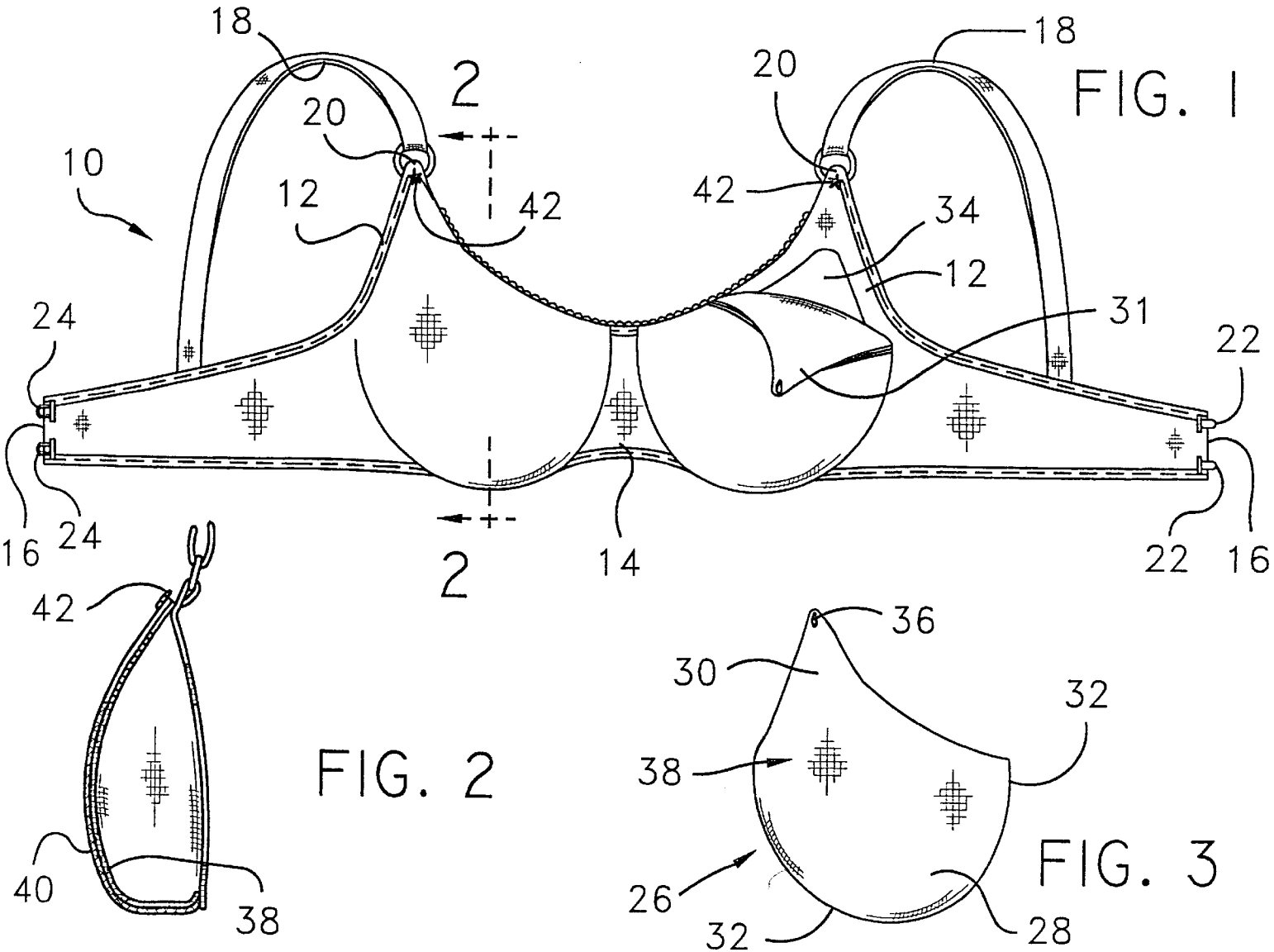
FIG. 1 is a schematic front view of a new nursing bra device according to the present invention.
FIG. 2 is a schematic cross-sectional view taken along line 2—2 of FIG. 1 of the present invention.
FIG. 3 is a schematic frontal view of the interior surface of the bra cup of the present invention.

With reference now to the drawings, and in particular to FIGS. 1 through 3 thereof, a new nursing bra device embodying the principles and concepts of the present invention and generally designated by the reference numeral 10 will be described.

As best illustrated in FIGS. 1 through 3, the nursing bra device 10 generally comprises a bra including a pair of cup frames 12 positioned on a torso strap 14. The torso strap 14 has a pair of ends 16. Each of a pair of shoulder 18 straps extends between an apex 20 of one of the cup frames 12 and the torso strap 14 between the associated cup frame 12 and a nearer end 16 of the torso strap 14. A fastening means removably fastens the first end of the torso strap to the second end of the torso strap 14. The fastening means preferably being a conventional hook 22 and eye-loop 24 type of fastening means used for bras.

Each of a pair of bra cups 26 has a bottom portion 28, an upper portion 30 and a peripheral edge 32. Each of the peripheral edges 32 of the bottom portions 28 of the bra cups 26 is attached to and extends along a bottom edge of one of the cup frames 12. The upper portions 30 each define a flap 31 for opening and closing an opening 34 defined by the cup frames 12. Each of the upper portions 30 has a hole 36 therein positioned adjacent to the peripheral edge 32 of the bra cups 26. The holes 36 are preferably located adjacent to the apex 20 of the cup frames 12 when the flap 31 is in a closed position covering the opening 34. Each of the bra cups 26 has an inner layer 38 and an outer layer 40. The inner layers 38 comprise an absorbent material and the outer layers comprise 40 a generally waterproof material. The hole may also be placed adjacent to the peripheral edge 32 and generally between the upper 30 and lower 28 portions.

A pair of hook members 42 selectively hold the flaps 31 in a closed position. Each of the hook members 42 is attached to one of the cup frames 12 and is located for extending into the holes 36 of the bra cups 26 for holding the flaps 31 in the closed position.

In use, the device 10 is used as a conventional nursing bra wherein the bra cups 26 may be opened for exposing the breast during feeding. Since the inner layer 38 of the bra cups 26 is absorbent, no additional pad is needed which often are inconvenient in looks and usefulness. The user, instead of removing pads as in conventional nursing bras, instead washes the entire device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A nursing bra device comprising:

a bra including a pair of cup frames positioned on a torso strap, said torso strap having a pair of ends, each of a pair of shoulder straps extending between an apex of one of said cup frames and said torso strap between the associated cup frame and a nearer end of the torso strap, a fastening means removably fastens a first end of said torso strap to a second end of said torso strap;

a pair of bra cups, each of said bra cups being attached to one of said cup frames such that a portion of each of said bra cups defines a flap for opening and closing an opening defined by said cup frames, each of said flaps having a hole therein, each of said bra cups having an inner layer and an outer layer, said inner layer comprising an absorbent material, said outer layer comprising a generally waterproof material;

a pair of hook members for selectively holding said flaps in a closed position, each of said hook members being attached to one of said cup frames and located for extending into said holes of said bra cups for holding said flaps in said closed position.

2. The nursing bra device as in claim 1, wherein each of said bra cups has a bottom portion and an upper portion and a peripheral edge, each of said peripheral edges of said bottom portions of said bra cups being attached to and extending along a bottom edge of one of said cup frames, said upper portions each defining said flap.

3. The nursing bra device as in claim 2, wherein said holes are located adjacent to said apex of said cup frames when said flap is in a closed position covering said opening.

4. A nursing bra device comprising:

a bra including a pair of cup frames positioned on a torso strap, said torso strap having a pair of ends, each of a pair of shoulder straps extending between an apex of one of said cup frames and said torso strap between the associated cup frame and a nearer end of the torso strap, a fastening means removably fastens a first end of said torso strap to a second end of said torso strap;

a pair of bra cups, each of said bra cups having a bottom portion and an upper portion and a peripheral edge, each of said peripheral edges of said bottom portions of said bra cups being attached to and extending along a bottom edge of one of said cup frames, said upper portions each defining a flap for opening and closing an opening defined by said cup frames, each of said upper portions having a hole therein positioned adjacent to said peripheral edge of said bra cups, said holes being located adjacent to said apex of said cup frames when said flap is in a closed position covering said opening, each of said bra cups having an inner layer and an outer layer, said inner layer comprising an absorbent material, said outer layer comprising a generally waterproof material;

a pair of hook members for selectively holding said flaps in a closed position, each of said hook members being attached to one of said cup frames and being located for extending into said holes of said bra cups for holding said flaps in said closed position.

* * * * *